US005691517A

United States Patent [19]

Yamamoto et al.

[11] Patent Number: 5,691,517

[45] Date of Patent: Nov. 25, 1997

[54] MULTIDIRECTIONAL LEVER SWITCH DEVICE

[75] Inventors: Tetsuo Yamamoto; Yoshikazu Taniguchi; Junichi Kojima, all of Yokkaichi, Japan

[73] Assignee: Sumitomo Wiring Systems, Ltd., Yokkaichi, Japan

[21] Appl. No.: 443,318

[22] Filed: May 17, 1995

Related U.S. Application Data

[63] Continuation-in-part of Ser. No. 341,878, Nov. 15, 1994.

[30] Foreign Application Priority Data

| | | | |
|---|---|---|---|
| Nov. 19, 1993 | [JP] | Japan | 5-314572 |
| Jul. 4, 1994 | [JP] | Japan | 6-176115 |
| Sep. 2, 1994 | [JP] | Japan | 6-234340 |

[51] Int. Cl.[6] ..... H01H 25/04

[52] U.S. Cl. ..... 200/6 A

[58] Field of Search ..... 200/4, 5 R, 5 A, 200/6 R, 6 A, 17 R, 18, 332, 335, 339, 517; 345/161; 364/190; 463/38

[56] References Cited

U.S. PATENT DOCUMENTS

| | | | |
|---|---|---|---|
| 4,052,578 | 10/1977 | Hoke | 200/153 L |
| 4,309,582 | 1/1982 | Coors | 200/153 T |
| 4,668,843 | 5/1987 | Watanabe et al. | 200/5 A |
| 4,739,128 | 4/1988 | Grisham | 200/6 A |
| 5,115,108 | 5/1992 | Ogawa et al. | 200/1 B |
| 5,426,275 | 6/1995 | Maeda et al. | 200/553 |
| 5,468,924 | 11/1995 | Natiou et al. | 200/6 A |
| 5,510,810 | 4/1996 | Nishijima et al. | 345/156 |

FOREIGN PATENT DOCUMENTS

| | | | |
|---|---|---|---|
| 0 246 968 | 11/1987 | European Pat. Off. | H01H 25/04 |
| 0 337 045 | 10/1989 | European Pat. Off. . | |
| 0 348 202 | 12/1989 | European Pat. Off. . | |
| 1268251 | 5/1968 | Germany | H01H 24/043 |
| 2 035 283 | 2/1971 | Germany | H01H 25/04 |
| 92 01 236.1 | 4/1992 | Germany | H01H 25/04 |
| 61-201244 | 12/1986 | Japan | H01H 25/04 |
| 2145502 | 3/1985 | United Kingdom | H01H 25/04 |

OTHER PUBLICATIONS

Barratt et al., "Joystick Controller for Pager Applications", Motorola Technical Developments, Feb. 1994, pp. 118–119.

*Primary Examiner*—Michael L. Gellner
*Assistant Examiner*—Michael A. Friedhofer
*Attorney, Agent, or Firm*—Oliff & Berridge

[57] ABSTRACT

A recess portion 14*a* is formed in the underside of the flange 14 of a tilting holder 13 at a position corresponding to, for example, an "upper right" select switch 4. As a result, the operating pin 10 of the "upper right" select switch 4 has a fixed gap with the flange 14. Consequently, the operating pin 10 of the "upper right" select switch is pressed when an operating lever 15 is tilted. However, the operating range B of, for example, the "upper right" select switch 4 is set narrower than the operating range A of, for example, the "upper" select switch 4 since the pressing of the operating pin 10 of, for example, the "upper right" select switch 4 is delayed by the gap resulting from the recess portion 14*a*.

10 Claims, 14 Drawing Sheets

MULTIDIRECTIONAL LEVER SWITCH DEVICE

This application is a Continuation-in-Part of application No. 08/341,878 filed on Nov. 15, 1994.

BACKGROUND OF THE INVENTION

The present invention relates to a lever switch device for activating switches by tilting an operating lever, and particularly to a multi-direction switch device that may be utilized as a so-called joystick or the like having a lever tiltable in multiple directions.

A switch device of such a type is used in, for example, a controller of a car navigation system. For example, the device is used in such a manner that a display state is changed by tilting a lever to the right side to scroll a map displayed on a monitor screen in the right direction, and by tilting the lever to the upper side to scroll the map in the upper direction.

In the switch device, a lever tiltable in multiple directions is provided, and a plurality of switches are arranged at regular intervals around the lever. When the lever is tilted, it presses and activates one of the switches.

Japanese Utility Model Publication (Kokai) No. Sho-61-201244/(1986), for example, discloses a lever switch device of the sort mentioned above. As shown in FIG. 1, the lever switch device is provided with an operating lever 72 comprising a substantially hemispherical rotor 73 which slidably contacts a hemispherical guide face 71 of an upper hollow portion of a housing 70 so as to be rotatably, guided, the rotor 73 including a sliding rod 74 which is slidably fitted into the rotor 73 and passed therethrough.

When the operating lever 72 is tilted from the neutral state, the sliding rod 74 and the rotor 73 are rotated an integral unit so that an operating pin 78 is pressed down by the outer peripheral edge of the lower face of the rotor 73. When the outer peripheral edge of the lower face of the rotor 73 is displaced by a predetermined operating stroke, a switch 79 arranged under the operating pin 78 is activated and when the operating lever 72 is released, it is restored to the neutral state by a return spring 81.

Assuming that the operating pin 78 and the switch 79 are disposed at, for example, right angles in four places: left, right, back and this sides, only the operating pin 78 placed in the right-hand position is pressed down when the operating lever 72 is tilted to the right in FIG. 1. When the outer peripheral edge of the underside of the rotor 73 is displaced by the predetermined operating stroke, only the switch 79 corresponding to the displacement is activated. When, however, the operating lever 79 is tilted in the direction between the right and back positions, the right operating pin 78 and the back operating pin (not shown) are simultaneously pressed down. Which one of both the operating pins causes the switch to be activated is determined by the direction in which the operating lever 72 is tilted. In other words, the operating lever 72 is tilted closer to the right position than what is at 45 degrees between the right and back positions so as to activate and validate the switch at the right position first on condition that the position-to-position operating strokes are equalized. On the other hand, the operating lever 72 is tilted closer to the back position than what is at 45 degrees therebetween to activate and validate the switch at the back position first. Since the position-to-position operating strokes have conventionally been made equal, the operating strokes capable of activating the switches by tilting the operating lever are equalized at every position.

However, the actual situation is that when the position-to-position frequencies of operation differ, it is desirable to set a wide operating range at a position where the operation is frequently performed. Notwithstanding, the conventional arrangement is unable to deal with such a situation as the operating range at each position is uniform.

In order to obviate an unstable operation at the time two switches adjacent to each other are simultaneously activated, there may be provided a circuit configuration for regarding one of the switches as what has been activated when the two switches are simultaneously activated. In a case where such a circuit configuration is furnished in the conventional arrangement, the operating range for one switch becomes wider than that of the other switch because the one switch is regarded as what has been pressed if the operating lever is tilted in the intermediate direction between the two switches adjacent to each other. Conversely, it is impossible to deal with the desire for uniformizing operating ranges at every position.

Furthermore, in the above mentioned lever switch device, the plurality of switches are interconnected into a matrix form as shown in FIG. 2 so as to constitute a switch matrix circuit, and the switch matrix circuit is connected to input terminals R1~R5 of a well-known remote control IC 1.

The remote control IC 1 has two output terminals T1, T2 through which timing signals are applied to the switch matrix circuit, and functions as what converts parallel signals applied to the data input terminals R1~R5 in response to timing signals t1, t2 into serial signals which are then output from a transmitting terminal (not shown). The switch matrix circuit applies parallel data to the data input terminals R1~R5 of the remote control IC 1 in accordance with the switch thus held ON when the timing signal t1, t2 are received. The relationship between a pressed switch and data bits is defined, for example, as shown in Table 1.

TABLE 1

| State of SW | t1 | t2 | d1 | d2 | d3 | d4 | d5 |
|---|---|---|---|---|---|---|---|
| Upper is ON | 1 | 0 | 1 | 0 | 0 | 0 | 0 |
| Right is ON | 1 | 0 | 0 | 1 | 0 | 0 | 0 |
| Lower is ON | 1 | 0 | 0 | 0 | 1 | 0 | 0 |
| Left is ON | 1 | 0 | 0 | 0 | 0 | 1 | 0 |
| Upper left is ON | 1 | 0 | 0 | 0 | 0 | 0 | 1 |
| Lower left is ON | 0 | 1 | 0 | 0 | 1 | 0 | 0 |
| Lower right is ON | 0 | 1 | 0 | 0 | 0 | 1 | 0 |
| Upper right is ON | 0 | 1 | 0 | 0 | 0 | 0 | 1 |

Table 1 shows that, in the case where the lever is tilted to the upper side and hence the switch positioned on the upper side is pressed, the switch matrix circuit outputs data "10000" to the input terminals R1~R5 of the remote control IC 1 when the timing signal t1 is output from the timing signal output terminal T1.

In a switch device of the sort mentioned above, because the lever can be tilted in multiple directions, switches adjacent to each other may simultaneously be activated according to some tilt directions of the lever.

In the conventional switch matrix circuit, the relationship between the group of switches that are held ON and digital data applied to the remote control IC 1 is preset as shown in Table 1. Accordingly, for example, where the switch on the upper side and the switch on the upper left side are simultaneously pressed, the switch matrix circuit outputs data "10001" when the timing signal t1 is output from the output terminal T1. As seen from Table 1, however, data is not previously defined. Consequently, the data code which is output through the transmitting terminal cannot be recognized and there occurs a phenomenon in which the map is not scrolled in any direction.

Where the switch on the upper side and the switch on the upper right side are simultaneously pressed, data "10000" is output when the timing signal t1 is output, whereas data "00001" is output when the timing signal t2 is output. Since the data codes each indicating that the switch on the upper side has been pressed and that the switch on the upper right side has been pressed are output then, it is impossible to determine which one of the switches has been pressed. Hence, the scroll direction remains undecided.

SUMMARY OF THE INVENTION

An object of the present invention made in view of the foregoing problems is to provide a lever switch device offering excellent operability by differentiating operating ranges at every position as desired.

Further, another object of the present invention is to provide a multidirectional lever switch device in which even when switches adjacent to each other are simultaneously pressed, either of the switches can be determined to be operated and which ensures excellent lever operability at the same time.

In order to accomplish the object above, a lever switch device according to the present invention comprises an operating lever which can be operated in tilting directions, a plurality of switch elements surrounding the operating lever, and operating units whose displacement is interlocked with the operating lever, the operating unit activating any one of the switches when displaced by a predetermined operating stroke in response to the tilting of the operating lever, wherein the operating stroke of each operating unit for activating the switch element is set different for some of the switch elements other than the remaining ones.

An image on a display unit is scrolled in conformity with the tilting of the operating lever, and one operating stroke for activating the switch element in a tilting direction in which the image is scrolled up and down thereon is set shorter than what is set therefor in another direction.

The operating lever is fitted in a longitudinal case, and an operating stroke for activating the switch element in a slantwise tilting direction with respect to the side of the case in the longitudinal direction is set shorter than what is set therefor in another direction.

A multidirectional switch device comprises a lever tiltable in multiple directions, a plurality of switches so located as to surround the lever, operating units, each of which is displaced in interaction with the lever to operate any one of the switches when it is displaced by a predetermined operating stroke in accordance with the tilting of the lever, and a switch matrix circuit with a plurality of switches interconnected into a matrix form, the switch matrix circuit being adapted for outputting digital data indicating which one of the switches has been activated in conformity with the direction in which the lever has been tilted. The operating stroke of a switch corresponding to one tilting direction is set longer than those of both switches adjacent to the one tilting direction. The digital data which is output from the switch matrix circuit when a switch corresponding to any one of the tilting directions is activated is set to conform to the logical sum of the digital data that are output when switches corresponding to both tilting directions adjacent to one tilting direction are activated.

According to the invention, the operating unit whose displacement is interlocked with the operating lever is capable of varying the operating stroke for activating the corresponding switch, switch element by switch element. If the operating stroke is shortened, the operating range where the switch element is activated is widened by tilting the operating lever and if it is lengthened, the operating range is narrowed thereby. Consequently, by varying the operating stroke, switch element by switch element, the operating range can be varied, switch element by switch element. It is therefore possible to vary the operating range for each switch element, depending on the frequency of activating the switch element. In order to obviate an indefinite range when two switches adjacent to each other are simultaneously pressed, the operating ranges for the switch elements adjacent to each other can be equalized by making the operating stroke for one switch element longer even when there is provided a circuit configuration for always regarding the one switch element as what has been pressed.

The lever switch device according to the invention is employed for scrolling an image on a display unit of a car navigation system, for example. Since the operating stroke for the switch element for scrolling such an image in the vertical direction is set shorter than another operating stroke in this case, the operating range of the operating lever capable of scrolling the image in the vertical direction is set wider than another. In other words, the operating range Of the operating lever for a switch whose frequency of operation is high becomes wide.

Further, according to the invention, the operating stroke for the switch element in a slantwise tilting direction, that is, in the direction in which the operating lever is not readily tilted with respect to the side of the case is set shorter than what is set therefor in another direction, whereby the operating range of the operating lever in the direction in which it is not readily tilted is made wider than another.

Moreover, according to the invention, when the lever is tilted in any one of the directions to activate one switch corresponding thereto, output is digital data which is the logical sum of the digital data that are output when switches corresponding to both tilting directions adjacent to the one tilting direction are activated.

Assuming the tilting directions of the lever and the digital data from the switch matrix circuit are set as shown in Table 2, for example, the following is output: "1100" is output when the switch located on the upper side is activated; "1000" when the switch located on the upper left side; and "0100" when the switch located on the upper right side.

TABLE 2

| State of SW | t1 | d1 | d2 | d3 | d4 |
|---|---|---|---|---|---|
| Upper is ON | 1 | 1 | 1 | 0 | 0 |
| Upper left is ON | 1 | 1 | 0 | 0 | 0 |
| Left is ON | 1 | 1 | 0 | 0 | 1 |
| Lower left is ON | 1 | 0 | 0 | 0 | 1 |
| Lower is ON | 1 | 0 | 0 | 1 | 1 |
| Lower right is ON | 1 | 0 | 0 | 1 | 0 |
| Right is ON | 1 | 0 | 1 | 1 | 0 |
| Upper right is ON | 1 | 0 | 1 | 0 | 0 |

In this case, the left and right upper directions are so related as to be adjacent to the upper direction, and the data "1100" assigned to the upper direction is the OR of the data "1000" assigned to the upper left direction and the data "0100" assigned to the upper right direction.

On the assumption that the switches located on the upper and upper left sides are simultaneously activated as the lever is tilted in the intermediate direction between the upper and upper left directions, the data "1100" output when the upper switch is pressed and the data "1000" output when the upper left switch is pressed are simultaneously output. After all, however, the data "1100" is still output from the switch matrix circuit since the d1 bits are the same. Even when the upper and upper left switches are simultaneously pressed, the upper switch is regarded as what has been pressed and no irregular operation will therefore ensue. When the lever is tilted in the intermediate direction between the upper and upper right directions, the upper switch is also regarded as what has been pressed and the switch device will be set free from such an irregular operation as well.

Incidentally, the logical sum (OR) according to the present invention means the logical sum OR in a broad sense, though it is synonymous with OR in a narrow sense in positive logic and synonymous with AND in a narrow sense in negative logic. For example, the data which is output when the upper switch is pressed may be "1011" as the narrow-sense AND of the data above on condition that the data output resulting from pressing the upper left switch is "0111" in negative logic and that the data output resulting from pressing the upper right switch is "1011".

With the arrangement of the invention, the operating stroke with the respect to the switch which has been set so that the OR of the output signals of the switches adjacent to what has been mentioned previously is set longer than the operating strokes of the switches adjacent thereto, whereby the tendency of making the operating range for the switch corresponding to the preferential tilting direction is offset.

According to the invention, although it has been arranged that the digital data which is output simultaneously with the activation of one switch corresponding to one tilting direction is the OR of the digital data output when the switches adjacent to the one switch are pressed, the operating ranges for every switch can be equalized by setting longer the operating stroke of the one switch corresponding to the one tilting direction than the operating strokes of the switches adjacent to the switches. Therefore, the switches whose frequencies of operation are equal can be operated without spoiling the operating feeling.

DETAILED DESCRIPTION OF PREFERRED EMBODIMENTS

First Embodiment

Referring FIGS. 3 through 9 inclusive, a description will subsequently be given of an embodiment of the present invention in the form of a lever switch device which is applied to an operating panel in a vehicular navigation system.

Figure 1:
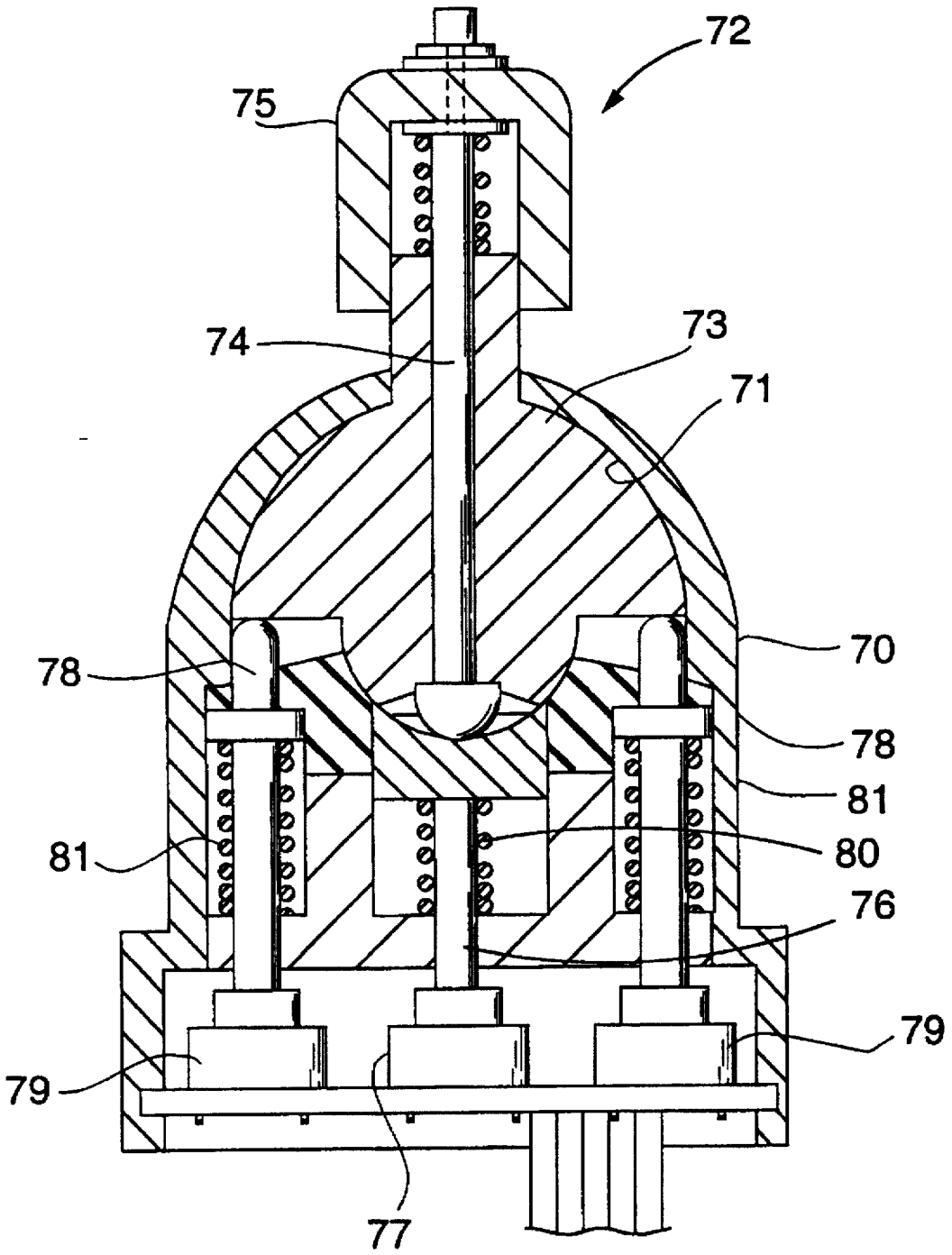
FIG. 1 PRIOR ART
FIG. 1 shows a vertical sectional view of a conventional lever switch.
Figure 2:
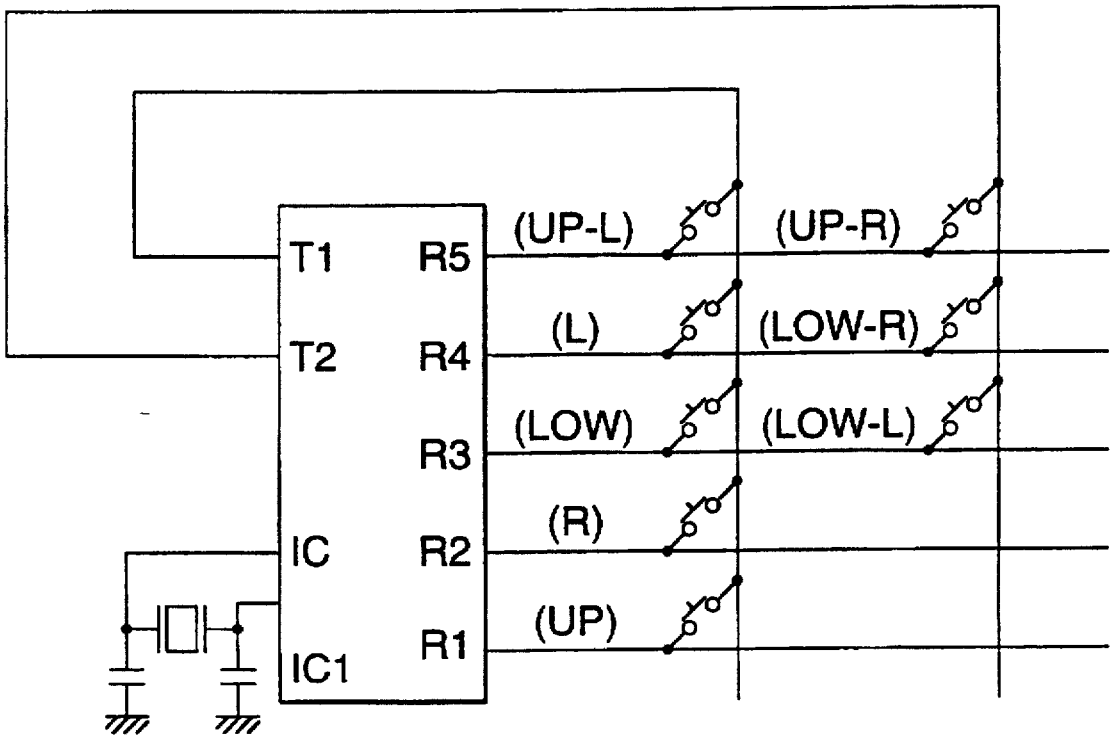
FIG. 2 PRIOR ART
FIG. 2 shows a circuit diagram showing a conventional switch matrix circuit.
Figure 3:
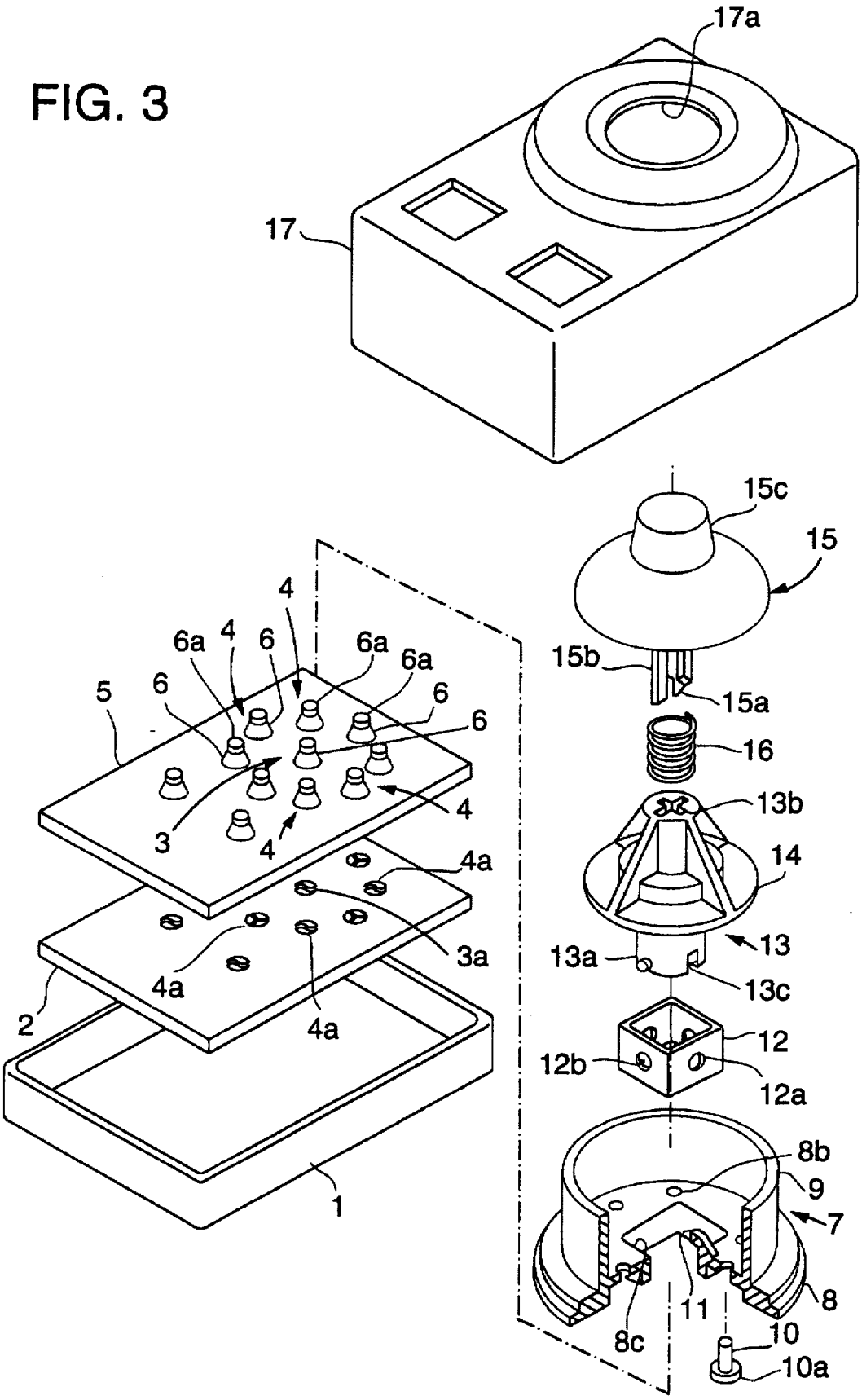
FIG. 3 shows an exploded perspective overall view of a embodiment of the invention of the present invention.

As shown in FIG. 3, a printed board 2 is securely furnished in a shallow tray-like square case 1, the printed board 2 having circuit components such as ICs, transistors, resistors, capacitors and the like (not shown) fitted to its underside. On the surface of the printed board 2, a pair of stationary contacts 3*a* for a set switch are disposed, and eight pairs of stationary contacts 4*a* for select switches are arranged at regular angular intervals of 45 degrees in a circle centering on the stationary contacts 3*a* for the set switch.

A rubber switch cover 5 having electric insulating properties and elasticity is secured to the surface of the printed board 2. The switch cover 5 as a whole is in the shape of a square thin plate covering the entire face of the printed board 2. Switch operating units 6 are formed at a total of nine positions each corresponding to the pair of stationary contacts 3*a* for the set switch and the eight pairs of stationary contacts 4*a* for the select switches and protrude in such a way that they are usually separated from the surface of the printed board 2.

Figure 4:
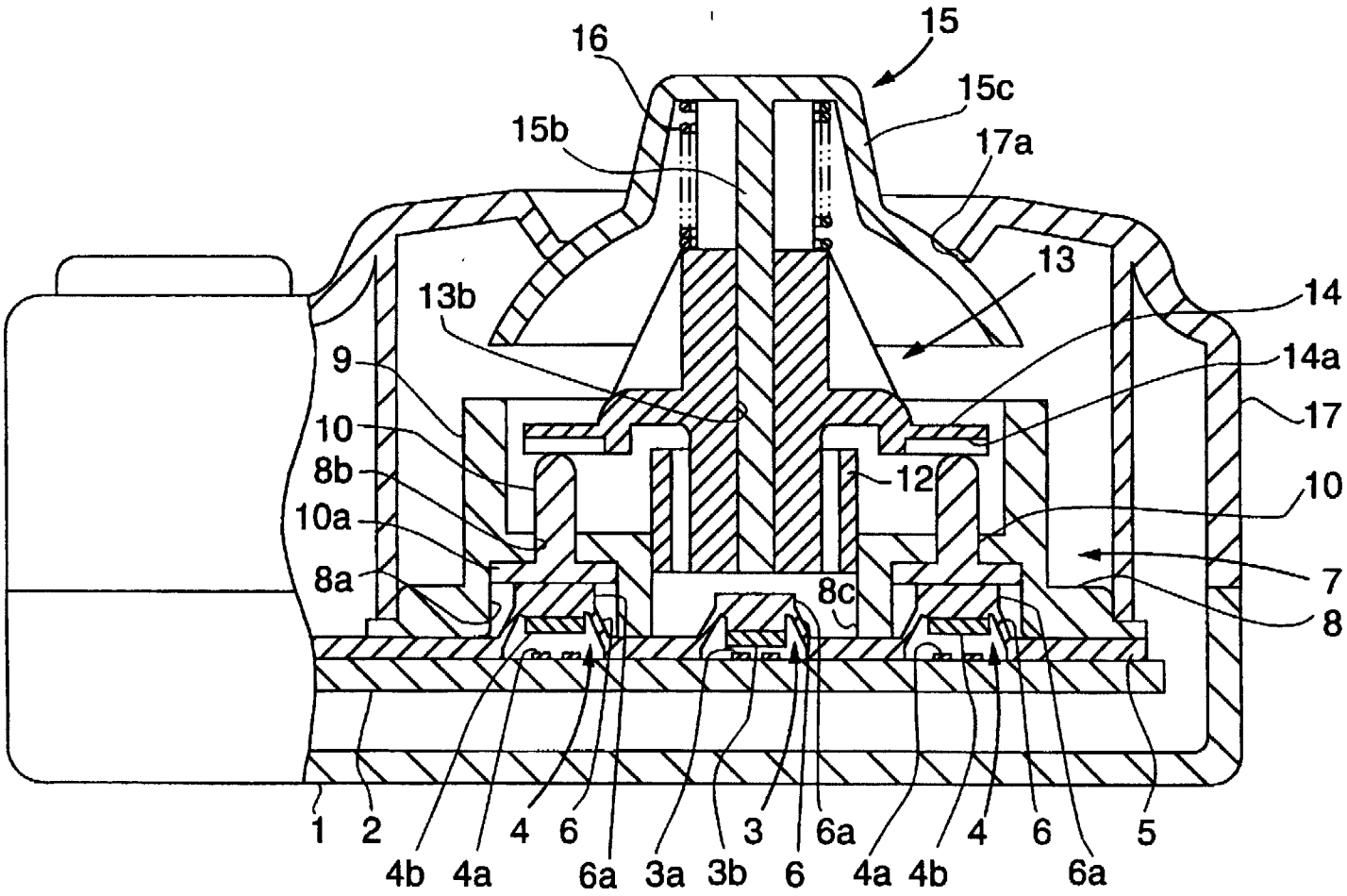
FIG. 4 shows a vertical sectional view of "upper right" and lower left select switches in the embodiment of FIG. 3.
Figure 5:
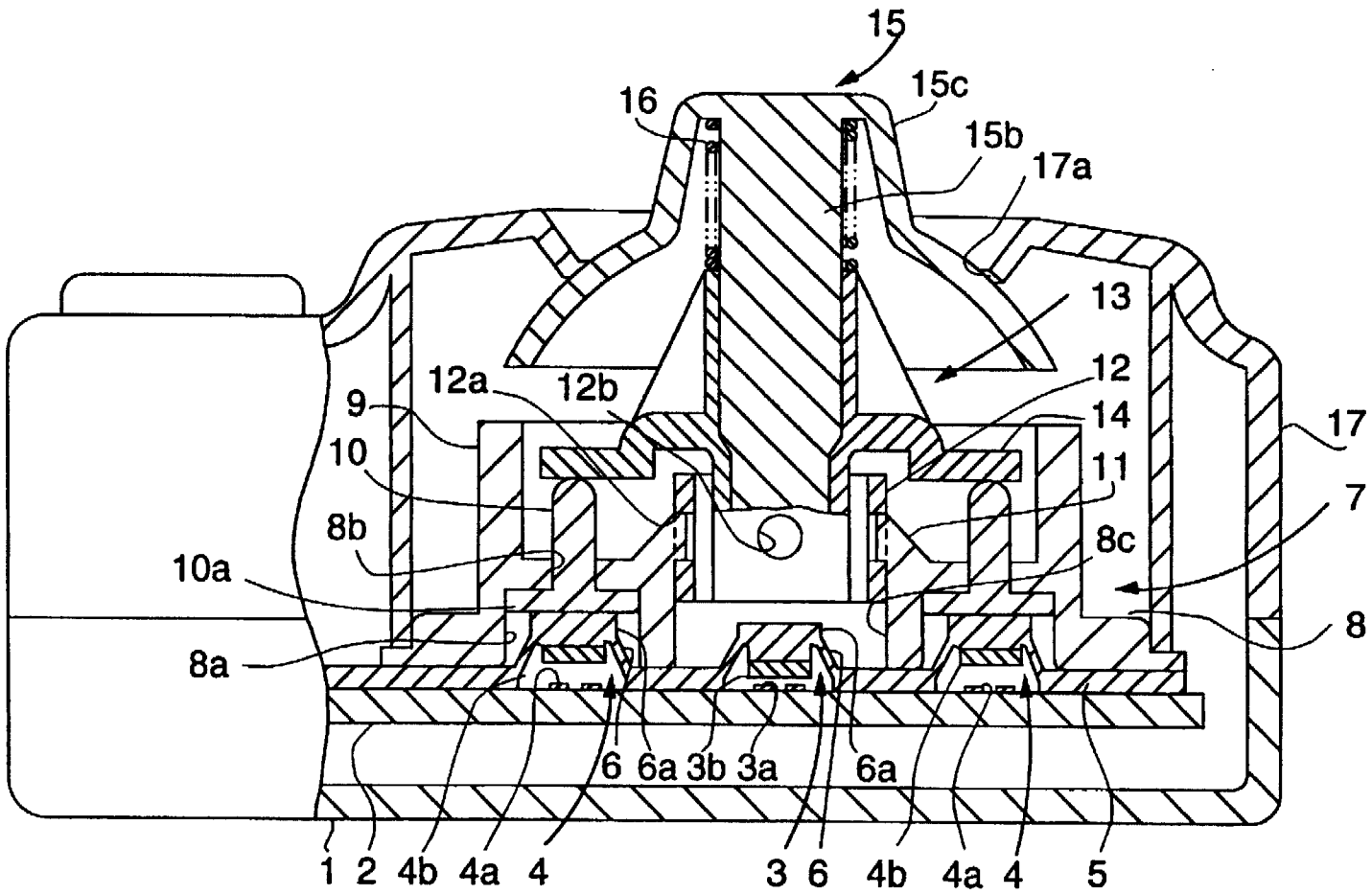
FIG. 5 shows a vertical sectional view of "upper" and "lower" select switches in the embodiment of FIG. 3.

As shown in FIGS. 4 and 5, each operating unit 6 is uprightly tapered from the surface of the switch cover 5 in such a way to surround the stationary contact 3*a*, 4*a*. A disk-like movable short-circuit conductor 3*b*, 4*b* made of an electrically conductive rubber material is secured to the back of a head portion 6*a*. The operating unit 6 is in the non-operating state in which the movable short-circuit conductor 3*b*, 4*b* is separated from the stationary contact 3*a*, 4*a*. When the head portion 6*a* is pressed down, there ensues its elastic deformation, thus causing the movable short-circuit conductors 3*b*, 4*b* to contact both the respective stationary contacts 3*a*, 4*a*, so that electrical continuity is established between the stationary contacts 3*a*, 4*a*. When the head portion 6*a* is released from the pressure applied thereto, moreover, the movable short-circuit conductor 3*b*, 4*b* is separated from the stationary contact 3*a*, 4*a* due to the elastic restoring force so as to restore the original non-operating state. Consequently, switch elements, that is, the stationary contact 3*a* and the movable short-circuit conductor 3*b* constitute one set switch 3, whereas the stationary contacts 3*a* and the movable short-circuit conductors 4*b* form eight select switches 4.

Of the eight select switches 4 around the set switch 3 as viewed from above the case 1 in FIG. 3, what is positioned on the upper side is called a "upper" select switch 4; what is positioned on the lower side a "lower" select switch 4; what is positioned on the right-hand side a "right" select switch 4; and what is positioned on the left-hand side a "left" select switch 4. Further, what is positioned between the upper and right-hand sides is called a "upper right" select switch 4; what is positioned between the upper and left-hand sides a "upper left" select switch 4; what is positioned between the lower and right-hand sides a "lower right" select switch 4; and what is positioned between the lower and left-hand sides a "lower left" select switch 4, the same applying to the following. When the "upper" select switch 4 is activated, the image displayed on a display unit of a navigation system (not shown) is scrolled upward and when another select switch 4 is activated likewise, the image is scrolled in the direction in which the select switch 4 is positioned.

On the switch cover 5 is a base 7 concentric with a circle in which eight pairs of select switches 4 around the set switch 3 are arranged, the base 7 being fixed in such a state that its peripheral edge portion is positioned by a cover 17, which will be described later. A cylindrical regulating upright portion 9 is integrally formed on the surface side of a bottom plate 8 on the base 7, the diameter of the cylindrical regulating upright portion 9 being slight larger than that of the circle in which the select switches are arranged.

In the bottom plate 8 of the base 7 are relief portions 8*a* formed by recessing the back of the bottom plate 8 so as to prevent the interference with the respective switch operating units 6, the relief portions 8*a* at eight positions each corresponding to the select switches 4. Further, guide holes 8*b* each communicating with the relief portions 8*a* up to the surface of the bottom plate 8 are formed in the upper relief portions 8*a*. An operating pin 10 having a presser portion 10*a* at its lower end is inserted into the relief portion 8*a* in such a state that the upper end of the operating pin 10 has been projected from the guide hole 8*b* toward the surface side of the bottom plate 8, whereby the presser portion 10*a* is allowed to move within the relief portion 8*a* in a direction perpendicular to the printed board 2. Incidentally, the operating pin 10 is normally pushed up because of the elastic restoring force of the operating unit 6 and the presser portion 10*a* is held on the ceiling of the relief portion 8*a*.

In the center of the bottom plate 8, a square through-hole 8*c* is opened so as to surround the set switch 3, and support shafts 11 are each provided at a pair of hole edges of the through-hole 8*c* out of those facing each other. The axial line of the support shafts 11 are passed through the center of the circle in which the eight pairs of select switches 4 are arranged on the printed board 2.

A square cylinder-like bearing bracket 12 is provided for the base 7, and bearing holes 12*a*, 12*b* are formed in the opposite sides of the bearing bracket 12. The support shafts 11 are fitted into the bearing holes 12*a*, and a rotary shaft 13*a* projecting from the lower end of a tilting holder 13 is fitted into the bearing holes 12*b*, whereby the tilting holder 13 is passed through the center of the circle in which the eight pairs of select switches 4 are disposed and rotatably supported with intersecting two axes. Further, the tilting holder 13 is made tiltable in any direction around the center of the circle in which the eight pairs of select switches 4 are arranged with the neutral posture perpendicular to the printed board 2 as a core.

Figure 6:
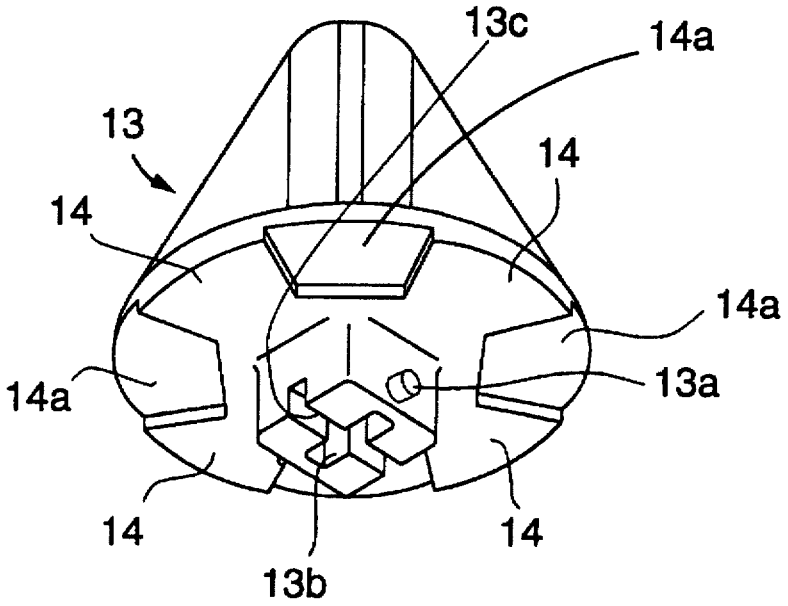
FIG. 6 shows a perspective view of a tilting holder 13 viewed from below in the embodiment of FIG. 3.
Figure 7:
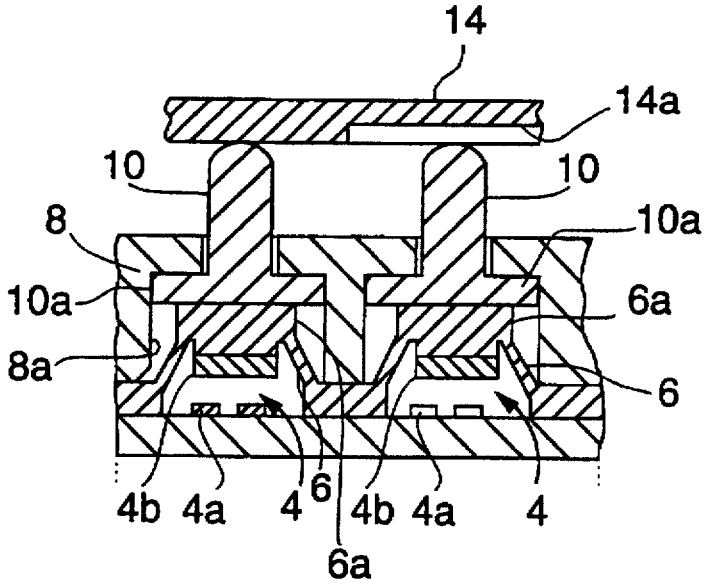
FIG. 7 shows a vertical sectional view of select switches adjacent to each other in the embodiment of FIG. 3.

A flange 14 is, as shown in FIG. 6, formed on the outer periphery of the tilting holder 13. In the underside of the flange 14, there are formed recess portions 14*a* each corresponding to the "upper right," "lower right," "upper left" and "lower left" select switches 4 out of the eight pairs of them. In the neutral state of the tilting holder 13 set perpendicular to the printed board 2, the upper ends of the "upper," "lower," "left" and "right" operating pins 10 out of eight of them fitted into the tilting holder 13 each abut against non-recessed portions on the underside of the flange 14, whereas the upper ends of the "upper right,," "lower right," "upper left" and "lower left" select switches 10 each have gaps with the underside of the flange 14 (see FIG. 7). As shown in FIG. 3, moreover, the tilting holder 13 is provided with a support hole 13*b* in cruciform section passing therethrough and ranging from the upper edge face up to the lower one along the direction of length thereof. A notch 13*c* is formed at the lower end of the tilting holder 13, and allowed to engage with a retaining portion 15*a* of an operating lever 15, which will be described later.

An operating lever 15 is provided up the tilting holder 13 and has a leg portion 15*b* in cruciform section and an umbrella-like knob portion 15*c* formed at its upper end. The leg portion 15*b* is fitted into the support hole 13*b* and consequently the operating lever 15 is made not only vertically movable but also, together with the tilting holder 13, tiltable. A compression coil spring as a return spring 16 fitted to the leg 15*b* of the operating lever 15. The return spring 16 urges the operating lever 15 upward and makes the retaining portion 15*a* formed at the lower end of the leg portion 15*b* fit into the notch 13*c* to render the operating lever 15 in the non-operating state. As a result, a predetermined gap is provided between the lower edge face of the leg portion 15*b* and the head portion 6*a* of the operating unit 6 of the set switch 3. The outer peripheral edge of the knob 15*c* of the operating lever 15 is substantially equal in diameter to the regulating upright portion 9 of the base 7, so that a predetermined gap is provided between the outer peripheral edge thereof and the regulating upright portion 9. When the knob portion 15*c* is tilted and moved down, the outer peripheral edge of the knob portion 15*c* abuts against the upper end of the regulating upright portion 9, whereby the movement of the knob portion 15*c* is controlled.

The case 1 is securely covered with a cover 17 in such a manner as to cover each component member, and a circular window hole 17*a* whose diameter is greater than that of the knob portion 15*c* of the operating lever 15 is formed in the front of the cover 17, the window hole 17*a* and the base 7 being concentric. The knob portion 15*c* is exposed through the window hole 23*a*.

The functions of the this embodiment of the invention will be described. The operating lever 15 is normally kept in the neutral state, and the one set switch 3 and the eight select switches are in the non-operating state. In order to activate the set switch 3 from this state, it is only needed to press the knob portion 15*c* of the operating lever 15. Then the lower edge face of the leg portion 15*b* of the operating lever 15 causes elastic deformation to the operating unit 6 and makes the movable short-circuit conductor 3*a* contact the stationary contact 3*a* for the set switch, so that the electrical continuity of the stationary contact 3*a* for the set switch is established. When the operating lever 15 is released from the pressure applied thereto to restor the original non-operating state, it is restored by the return spring 16 to the non-operating state, and the movable short-circuit conductor 3*b* is separated from the stationary contact 3*a*.

In order to activate the select switch 4, the knob portion 15*c* of the operating lever 15 needs tilting in any one of the eight directions. When the knob portion 15*c* of the operating lever 15 is tilted in the "upper" direction, for example, the tilting holder 13 tilts in the "upper" likewise in according with the tilting of the operating lever 15. Then the operating pin 10 of the "upper" select switch 4 is pressed against the printed board 2 and the switch operating unit 6 undergoes elastic deformation so as to make the movable short-circuit conductor **4*b* contact the stationary contact 4*a*. Consequently, the electrical continuity of the stationary contact 4*a* is established. When the operating lever 15 is released from the tilting operation to restore its original non-operating state, the operating lever 15 is restored to the original non-operating state due to the elasticity of the Switch operating unit 6**.

A description will subsequently be given of a case where the knob portion **15*c* of the operating lever 15 is tilted in the "upper right" direction. When the knob portion 15*c* of the operating lever 15 is tilted, the tilting holder 13 also tilts in this case in response to the tilting of the operating lever 15. Unlike the case where the operating lever 15 is tilted in the "upper" direction, the operating pin 10 is not instantly pressed by the flange 14 since a slight gap is provided between the underside of the flange 14 and the operating pin 10 of the "upper right" select switch 4 but pressed by the operating pin 10 after the tilting holder 13 makes a predetermined tilting angle. As the operating lever 15 is tilted further, the operating pin 10 presses down the head portion 6*a* of the switch operating unit 6 to cause its elastic deformation and moves down, so that the movable short-circuit conductor 4*b* contacts the stationary contact 4*a* (see FIG. 8). As a result, the stationary contact 4*a* conducts. Then the operating lever 15** is released from the tilting operation so as to restore its original non-operating state.

The observation made on the operating stroke for the select switch 4 at the flange 14 until the movable short-circuit conductor **4*b* contacts the stationary contact 4*a* after the operating lever 15 is tilted from the neutral state reveals the fact that the operating stroke in the case where the operating lever 15 is tilted in the "upper right" direction is longer than the case where it is tilted in the "upper" direction. This is because the operating pin 10 of the "upper" select switch 4 is pressed simultaneously with the tilting of the tilting holder 13, whereas the operating pin 10 of the "upper right" select switch 4 is pressed after the tilting holder 13 is tilted in the "upper right" direction by the gap resulting from the recess portion 14*a***.

Figure 9:
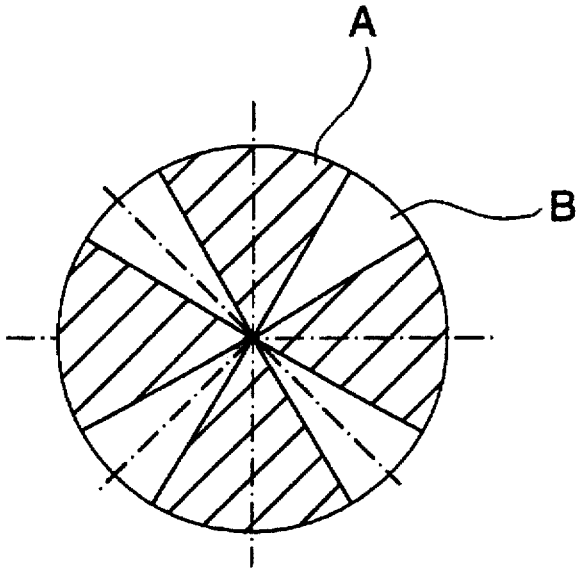
FIG. 9 shows a diagram illustrating an operating range for each select switch in the embodiment of FIG. 1.

Assuming that the operating lever 15 is tilted in the intermediate direction substantially between, for example, the "upper" and "upper right" select switches 4 adjacent to each other, the "upper" operating pin 10 is first pressed by the flange 14 and the "upper right" operating pin 10 is pressed. The "upper" operating pin 10 causes the elastic deformation of the switch operating unit 6 so as to make the movable short-circuit conductor **4*b* contact the stationary contact 4*a*, whereas the "upper right" operating pin 10 causes the switch operating unit 6 to undergo only slight elastic deformation. The movable short-circuit conductor 4*a* will never contact the stationary contact 4*a* as the movement of the former is controlled by the operating pin 10 that has been pressed first. In other words, when the operating lever 15 is tilted in the intermediate direction substantially between the "upper" and "upper right" select switches 4, the "upper" select switch 4 is activated, whereas the "upper right" select switch 4 is not. As shown in FIG. 9, the operating range A for the "upper" select switch 4 becomes wider than the operating range B for the "upper right" select switch 4**.

By forming the recess portion **14*a* in the flange 14 of the tilting holder 13 according to this embodiment of the invention, the operating ranges for the "upper," "lower," "left" and "right" select switches 4 can be set wider than those for the "upper right," "lower right," "upper left" and "lower left" select switches 4. Since an image is more frequently scrolled in the upper, lower, left and right directions than upper right, lower right, upper left and lower left directions in a car navigation system, the operating range for the select switch 4 frequently activated is widened, whereas the operating range for the select switch 4** less frequently activated, whereby the operability of the lever switch device is improved.

Second Embodiment

Figure 10:
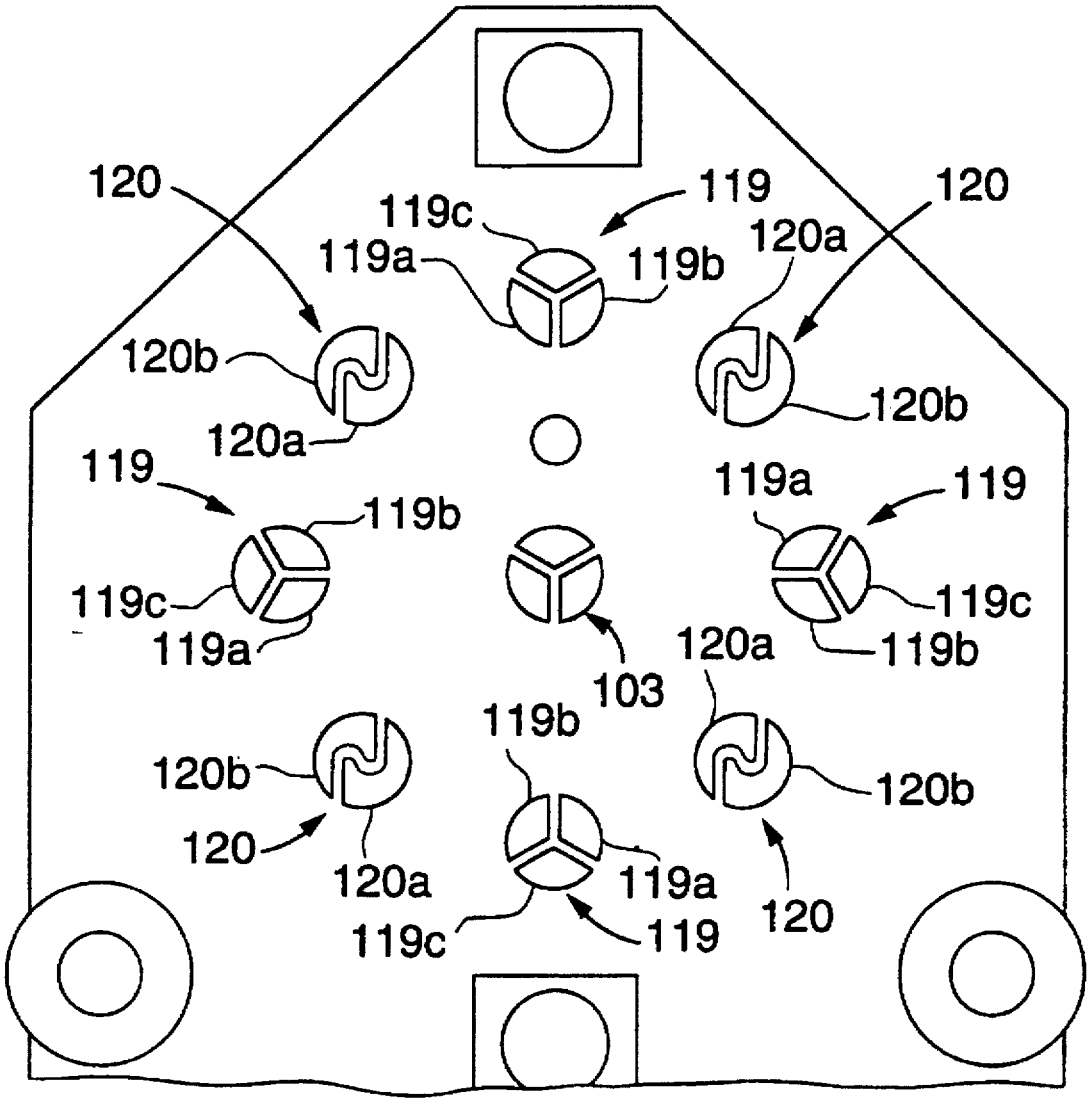
FIG. 10 shows a top view of a board indicating each stationary contact in the present invention.

A description will subsequently be given of a layout pattern of the stationary contacts in reference to the select switches 4 (FIG. 10). In the group of eight select switches 4 arranged at regular angular intervals, the select switches **119*s* each corresponding to four directions: the upper, lower, left and right directions (which refer to the tilting directions of the operating lever 15, the same applying to the following), each including three stationary contacts 119*a*, 119*b*, 119*c* shaped by dividing a circle into three equal parts. The two stationary contacts 119*a*, 119*b* are disposed symmetrically on both sides of a line connecting the select switches 119, 3. The remaining stationary switch 119*c* is located on the outer peripheral side with respect to the stationary contacts 119*a*, 119*b*. These stationary contacts 119*a*, 119*b*, 119*c* together with the short-circuit conductor constitute a 2-circuit 3-contact switch with the stationary contact 119*c* used as a common line. Moreover, four select switches 120 each positioned between the four select switches 119 correspond to the four oblique directions: the upper right, lower right, lower left and upper left directions. Each stationary contact 120 includes two stationary contacts 120*a*, 120*b***, which together with the short-circuit conductor constitute a 1-circuit 2-contact switch.

Figure 11:
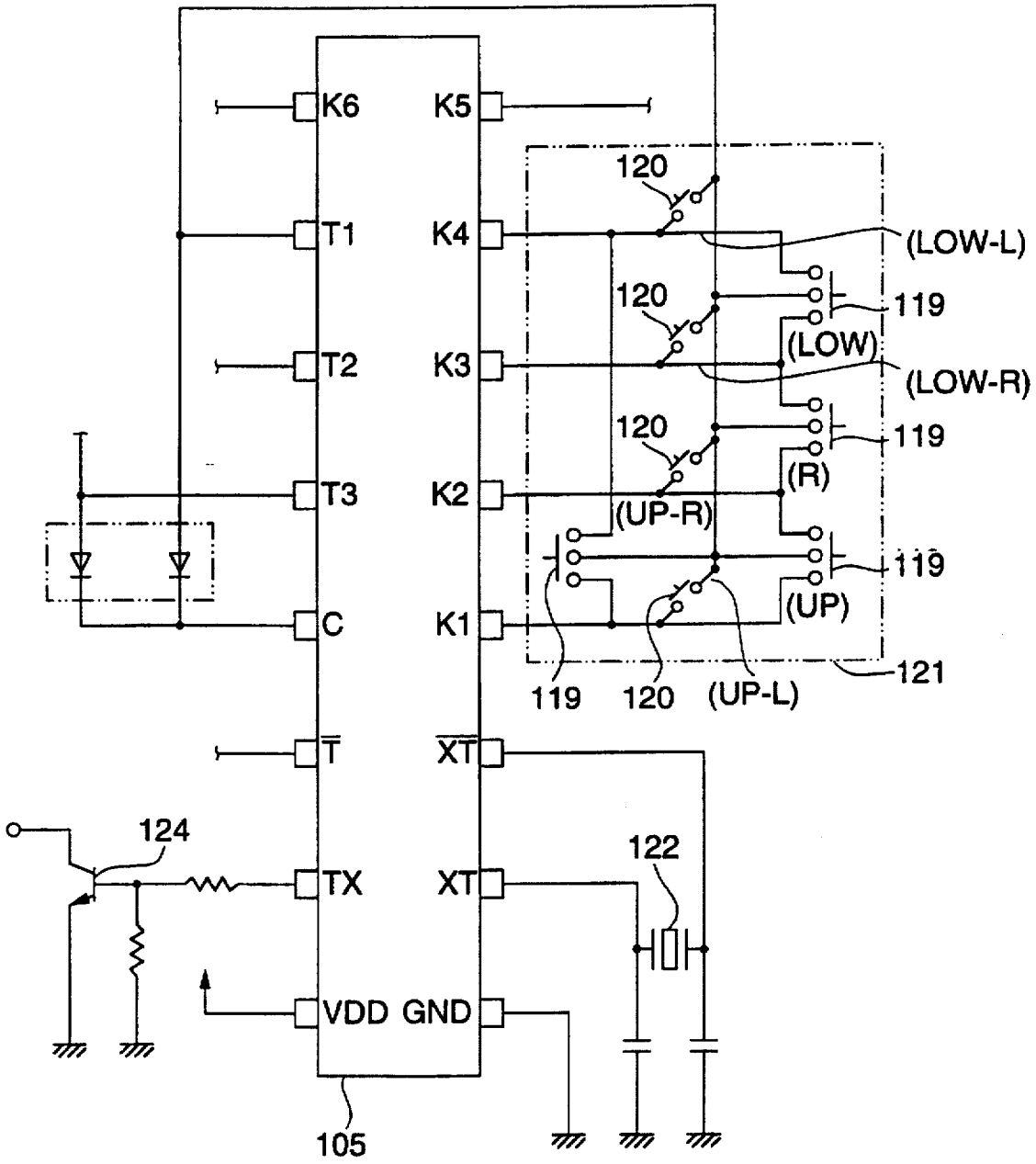
FIG. 11 shows a circuit diagram indicating a switch matrix circuit in the present invention.

Subsequently, an electric arrangement will be described. As shown in FIG. 11, the eight select switches 119, 120 are interconnected into a matrix form to constitute a switch matrix circuit 121 which is connected to the IC 105.

The IC 105 is equipped with 6-bit input terminals K1~K6 (K1~K4 are used in this embodiment of the invention) capable of receiving parallel digital data. Digital data input therethrough are converted into a serial data code by a converter (not shown) in the remote control IC 105, and the serial data code is output through a transmitting terminal Tx. Moreover, output terminals T1~T3 (T1 is used in this embodiment of the invention) are provided so as to indicate that the input terminals K1~K6 are allowed to receive digital data. At predetermined timing, timing signals t1~t3 (t1 is used in this embodiment of the invention) having a logical value of "1" are each output from the output terminals T1~T3. Further, a clock generator (not shown) is provided in the IC 105 to time the inner circuits, and is externally connected to a ceramic oscillator 122.

The switch matrix circuit 121 will Subsequently be described. The one stationary contact **119*a* positioned on the inner peripheral side of the upper select switch 119 together with the stationary contact 120*a* of the upper left select switch is connected to the data input terminal K1. The other stationary contact 19*b* together with the stationary contact 120*a* of the upper right select switch 120 is connected to the data input terminal K2. In addition, the stationary contact 119*c* positioned on the outer peripheral side, together with the other stationary contacts 120*b*, 120*b* of the upper left and upper right select switches, is connected to the output terminal T1 of the remote control IC 105. Consequently, the switch circuits of the select switch 119 positioned on the upper side are connected in parallel to the switch circuits of the select switches 120 situated on both sides. Similarly, the remaining lower left and right select switches 119 are connected so that their switch circuits are in parallel to those of the select switches 120** positioned on both sides.

Figure 8:
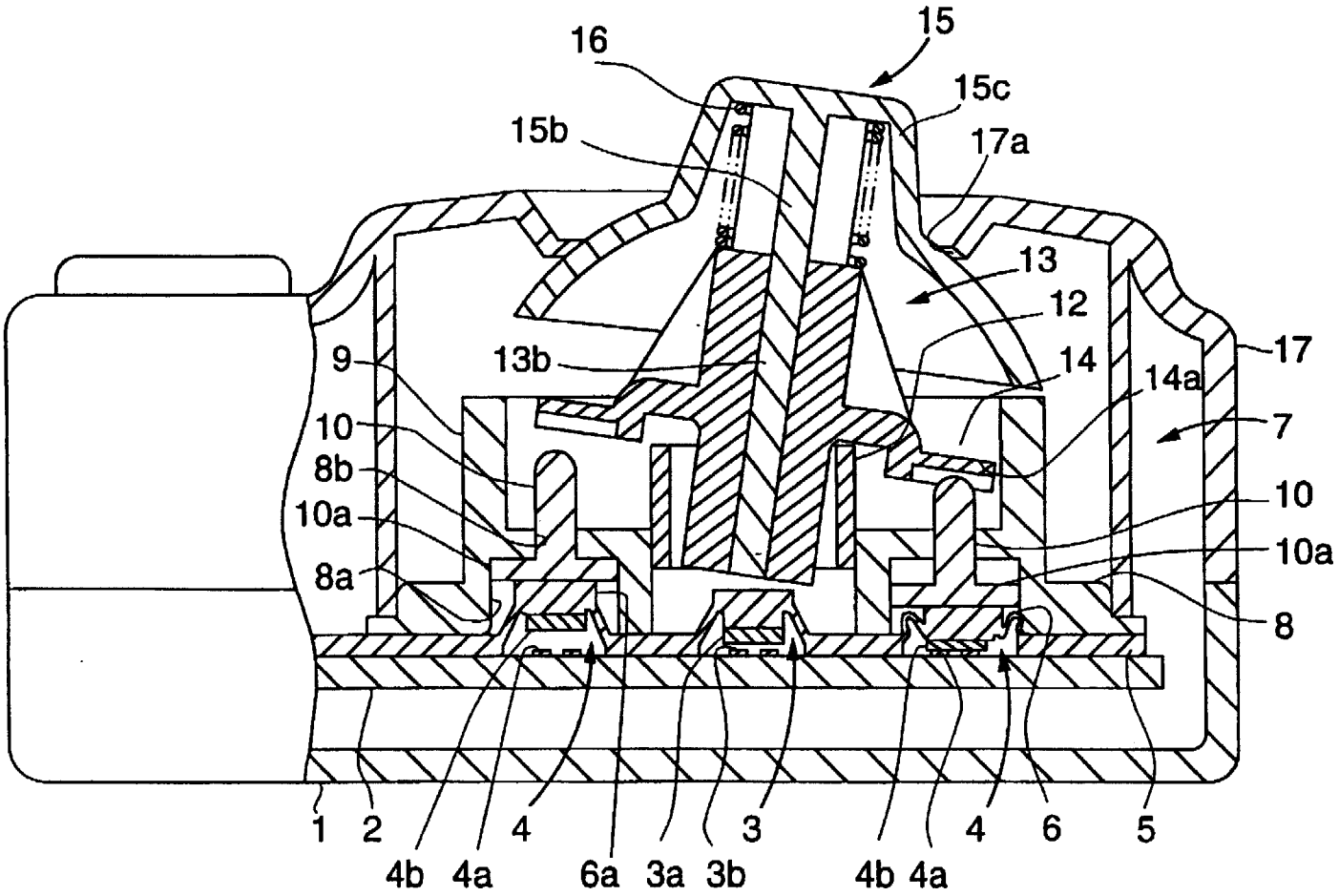
FIG. 8 shows a vertical sectional view illustrating the operating state of the "upper right" select switch in the embodiment of FIG. 1.

The functions of this embodiment of the invention will be described. When the knob portion 15*c* of the operating lever 15 in the neutral state is tilted upward, the operating lever 15 and the tilting holder 13 are tilted. The operating pin 10 positioned in the tilting direction is then pressed in by the flange 14 of the tilting holder 13, and the switch operating unit is pressed by the operating pin 10 and elastically deformed. As shown in FIG. 8, the short-circuit conductor 4*b* of the deformed switch operating unit contacts the stationary contacts 119*a*, 119*b*, 119*c* of the upper select switch 119. Consequently, the two stationary contacts 119*a*, 119*b* positioned on the outer peripheral side are short-circuited so as to establish electric continuity therebetween, whereby the respective switch circuits are activated.

When the timing signal t1 ("1") is output from the terminal T1 of the IC 105, the logical value "1" is output from the stationary contacts 119*a*, 119*b* of the upper select switch 119, and is then given to the input terminals K1, K2 of the IC 105. At this time, the input terminals K3, K4 at which no logical value has been applied are pulled down by resistors and therefore they have a value of "0", and the digital data "1100" is supplied to the input terminals K1~K4 of the IC 105. Then the data supplied to the IC 105 is converted into a serial data code for indicating that the upper select switch 119 has been pressed, and the data code is output from the transmitting terminal Tx before being transmitted via a buffer 124. In the same way, digital data are each output from the other select switches 119, 120 when these switches are pressed and the relationship between the former and the latter are shown in Table 2.

Since the operating lever 15 is tiltable in any desired direction, the adjacent select switches 119, 120 may simultaneously be pressed. When the upper select switch 119 and the upper left select switch 120 are simultaneously pressed, for example, the digital data "1100" is output in the former case, and the digital data "1000" in the latter case. Since both the d1 bits are "1" in this case, the digital data "1100" indicating the upper select switch 119 thus pressed is output from the switch matrix circuit 121. When the upper select switch 119 and the upper left select switch 20 are simultaneously pressed, the two switches are not regarded as those which have simultaneously been pressed but the upper select switch 119 is regarded as what has been pressed and no irregular operation will therefore ensue. When the operating lever 15 is tilted in a direction between the upper and upper right directions to press the upper and upper right select switches simultaneously, the digital data "1100" is output likewise and as the upper select switch 119 is regarded as what has been pressed, no irregular operation will ensue.

In order to obviate an indefinite range when two switches adjacent to each other are simultaneously pressed, there may be arranged a circuit configuration for always regarding one switch element as what has been pressed when the switch elements adjacent to each other are simultaneously pressed. If such a circuit configuration is added to the conventional arrangement, one switch will be always regarded as what has been pressed when an operating lever is tilted in the intermediate direction between select switches adjacent to each other and the operating range for the one switch will become wider than what is intended for the other. The operating ranges for the select switches adjacent to each other are equalized by making longer the operating stroke for one select switch so as to narrow the enlarged operating range on condition that the operating strokes for the select switches can be set equal as in the case of this embodiment of the invention. Therefore, the circuit configuration like this can deal with a case where operating ranges for all select switches are required to be uniformized, so that a lever switch device offering excellent operability is provided.

Figure 12:
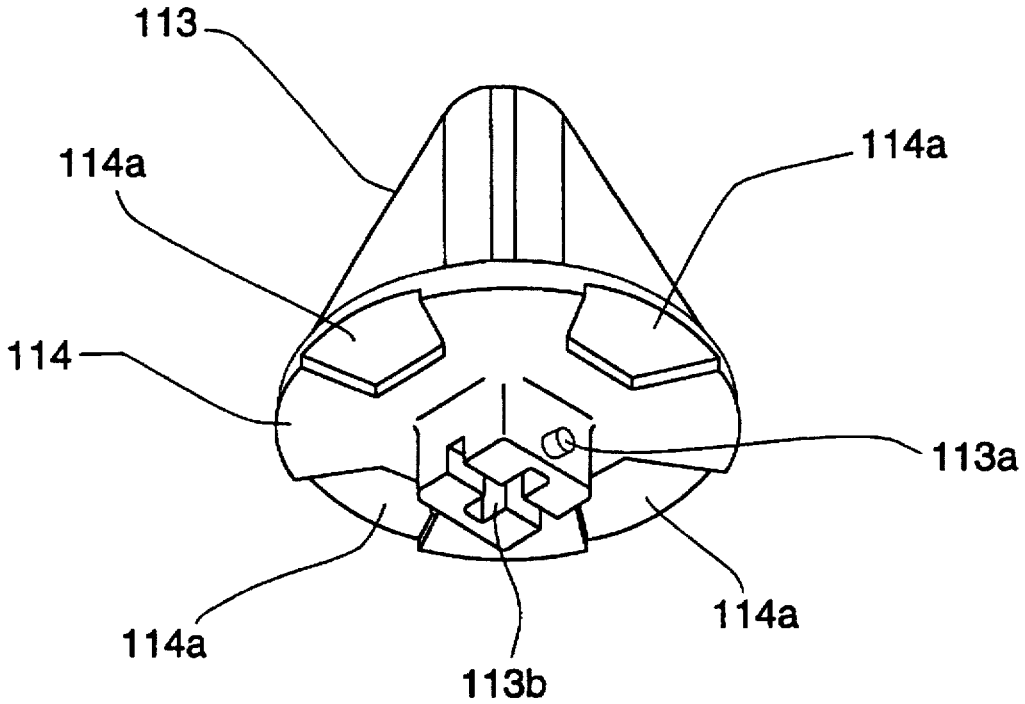
FIG. 12 shows a perspective view of the underside of a tilting holder in a second embodiment of the present invention.
Figure 13:
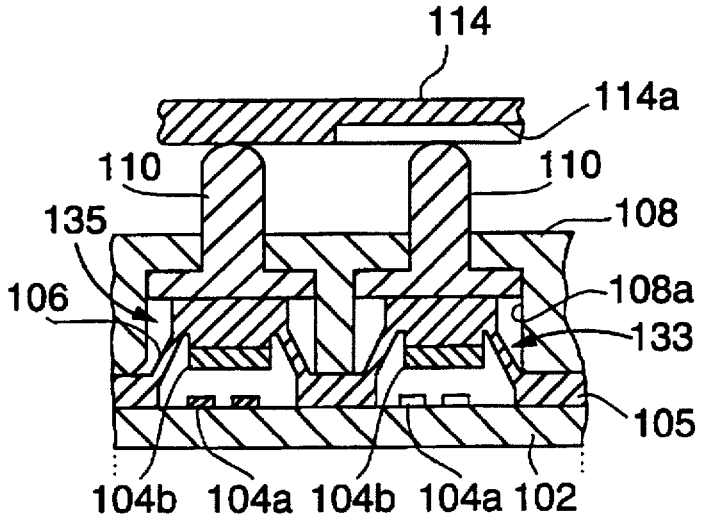
FIG. 13 shows a vertical sectional view of select switches adjacent to each other in the present invention.
Figure 14:
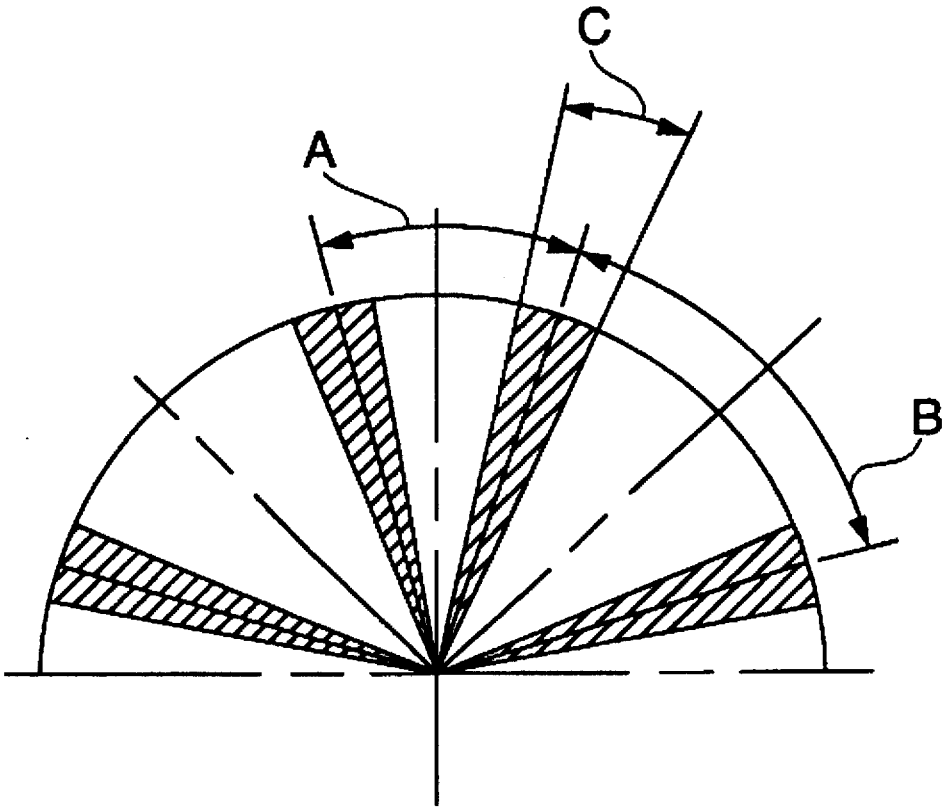
FIG. 14 shows an elevational view of an operating range in the second embodiment of the present invention.

Referring to FIGS. 12 through 14, a second embodiment of the present invention will subsequently be described in detail.

In the underside of the flange 114 of a tilting holder 113, there are formed, as shown in FIG. 12, recess portions 114*a* in positions each corresponding to "upper," "lower," "left" and "right" select switches 133. While the tilting holder 113 remains in the neutral state, a fixed gap is, as shown in FIG. 13, provided between the upper end of the operating pin 134 of, for example, the "upper" select switch 133 (on the right-hand side of FIG. 13) and the flange 114. Moreover, the upper end of the operating pin 110 of the "upper right" select switch 135 (on the left-hand side of FIG. 13) abuts against the underside of the flange 114 as in the case of the first embodiment of the invention.

Now when the operating lever is tilted in the "upper right" direction from the neutral state, the operating pin 110 is pressed down by the flange 114 of the tilting holder 113 immediately after the operating lever is tilted; this is because the upper end of the operating pin 110 abuts against the underside of the flange 114. When the operating lever is tilted further, a switch operating unit 106 undergoes elastic deformation so as to cause a short-circuit conductor 104*b* to contact a stationary contact 104*a*.

When the operating lever is subsequently tilted in the "upper" direction, the tilting holder 113 tilts likewise. Since the fixed gap is provided between the operating pin 110 and the flange 114, however, the operating pin 110 is not immediately pressed by the flange 114 as the operating lever tilts but pressed after the operating lever is tilted to predetermined angles. When the operating lever is tilted further, the switch operating unit 106 undergoes elastic deformation so as to cause the short-circuit conductor to contact, so that the stationary contact conducts.

The observation made on the operating stroke at the flange 114 until the short-circuit conductor 104*b* contacts the stationary contact 104*a* after the operating lever is tilted from the neutral state reveals the fact that the operating stroke in the case where the operating lever is tilted in the "upper" direction is longer than the case where it is tilted in the "upper right" direction. This is because the operating pin 110 of the "upper right" select switch is pressed simultaneously with the tilting of the tilting holder 113, whereas the pressing of the operating pin 110 of the "upper" select switch 133 is delayed by the gap resulting from the recess portion 114*a*.

Assuming that the operating lever is tilted in the intermediate direction substantially between, for example, the "upper" and "upper right" select switches, the "upper right" operating pin 110 is first pressed by the flange 114 and the "upper" operating pin 110 is pressed. Then the "upper right" operating pin 110 makes the switch operating unit 106 undergoes elastic deformation to cause the short-circuit conductor 104*b* to contact the stationary contact 104*a*. On the other hand, the "upper" operating pin 110 makes the switch operating unit 106 undergo slight elastic deformation, the short-circuit conductor 104*b* whose movement is controlled by the operating pin 110 is restrained from contacting the stationary contact 104*a*.

When the lever is tilted in the intermediate direction substantially between the "upper" and "upper right" select switches 133, 135, the "upper right" select switch 135 is activated, whereas the "upper" select switch 133 is not. As shown in FIG. 14, the operating range A for the "upper" select switch 133 becomes narrower than the operating range B for the "upper right" select switch 135 accordingly.

An indefinite range C (the range of hatching) exists in the vicinity of the boundary between the operating ranges A, B, and the select switches 133, 135 adjacent to each other may simultaneously be activated. In the indefinite range C, the digital data output when the "upper" select switch 133 is pressed is the logical sum of the digital data output when the "upper right" and "upper left" select switches 135. Therefore, the "upper" select switch 133 is always regarded as what has preferentially been activated.

The select switch corresponding to one preferential tilting direction is always regarded as what has been pressed even though both the select switches are simultaneously pressed by tilting the operating lever is tilted in the intermediate direction between the two select switches. Although this means to ensure a stable operation as noted previously with reference to the first embodiment of the invention, the operating range for the select switch corresponding to the preferential tilting direction increases, whereas the operating range for those each corresponding to the other tilting directions proportionally decreases to that extent. When the operating characteristics like this are applied to a select switch whose operating frequency differs, depending on the direction, an operating range which becomes wider in the direction in which the operating frequency is high may advantageously be assigned to such a select switch. In the absence of the situation above, however, there may arise inconvenience in a case where the whole operating range is desired to be equally assigned to every direction.

The operating stroke of the "upper" select switch 133 corresponding to the preferential tilting direction is set longer than that of the "upper right" select switch 135 adjacent to the former, whereby the operating range for the "upper" select switch 133 becomes narrow, whereas that of the "upper right" select switch 135 becomes wide. Consequently, the operating range for the "upper" select switch 133 corresponding to the preferential tilting direction is restrained from increasing.

In order to assure the stable operation in the indefinite range, the operating ranges for the respective select switches 133, 135 can be uniformized even though the digital data which is output simultaneously with the activation of the select switch 133 corresponding to one tilting direction is the OR of the digital data output when the select switches 135 adjacent to the one switch 133 are pressed. Consequently, the operating feeling is set free from being impaired when the select switches 133, 135 are activated with the same frequency.

The present invention is however not limited to the embodiments of the present invention set forth above but may be modified as follows, for example, and the following are also technically within the scope of the present invention: In this case, like reference characters designate like component parts and the description thereof will be omitted.

Figure 15:
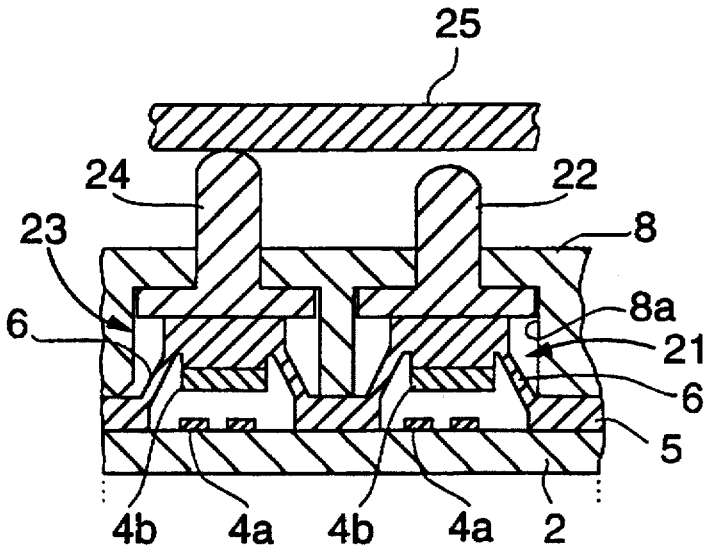
FIG. 15 shows a vertical sectional view of select switches adjacent to each other with operating pins different in length.
Figure 16:
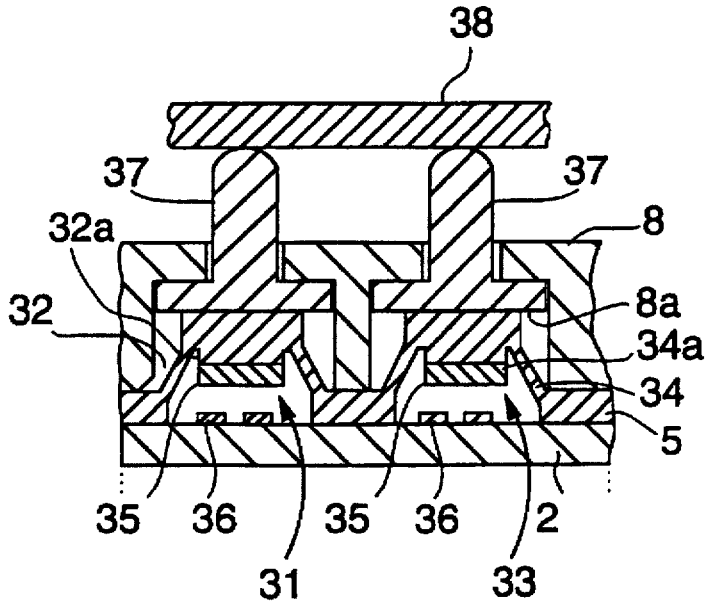
FIG. 16 shows a vertical sectional view of select switches adjacent to each other with the undersides of head portions of switch operating units different in thickness.
Figure 17:
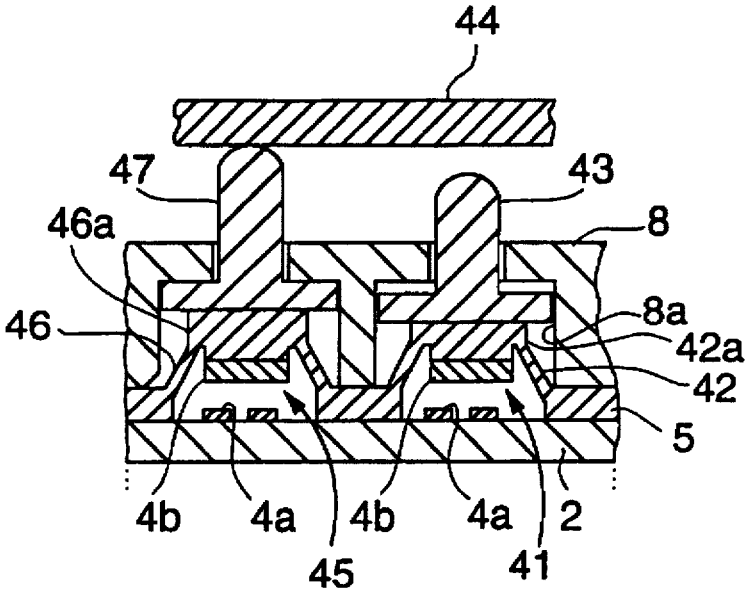
FIG. 17 shows a vertical sectional view of select switches adjacent to each other with the head portions of switch operating units different in thickness.

(i) The recess portions 14*a* are formed in the underside of the flange 14 of the tilting holder 13 so as to make the operating strokes for the "upper," "lower," "left" and "right" select switches 4, and the "upper right," "lower right," "upper left" and "lower left" select switches 4 different from each other in the above embodiment of the invention. However, the following alternatives are also possible.

a) As shown in FIG. 15, the operating pins 22 of "upper right," "lower right," "upper left" and "lower left" select switches 21 (on the right-hand side of FIG. 15) are set shorter than the operating pins 24 of "upper," "lower," "left" and "right" select switches 23 (on the left-hand side of FIG. 15). Consequently, there is provided a fixed gap between the upper end of the "upper right" operating pin 22 and the underside of a flange 25. In a case where the operating lever is tilted in the "upper right" direction, for example, the operating pin 22 is not pressed by the flange 25 immediately after the operating lever is tilted but pressed after it is slightly tilted. Accordingly, the operating stroke for the "upper right" select switch 21 is made longer than that of the "upper" select switch 23, for example, whose operating pin 24 is pressed immediately after the operating lever is tilted as in the case of the embodiment of the invention above.

b) As shown in FIG. 16, in reference to "upper," "lower," "left" and "right" select switches 31 (on the left-hand side of FIG. 16), the underside 32*a* of the head portion of each switch operating unit 32 is made thicker than the underside 34*a* of the head portion of the switch operating unit 34 of an "upper right," "lower right," "upper left" or "lower right" select switch 33 (on the right-hand side of FIG. 16). Consequently, the distance between the movable short-circuit conductor 35 and a stationary contact 36 is set shorter than the distance between the movable short-circuit conductor 35 of a select switch 33 and a stationary contact 36. When the operating pin is tilted in the "upper" direction, for example, an operating pin 37 is pressed by a flange 38. As the movable short-circuit conductor 35 is allowed to contact the stationary contact 36 by slightly pressing, the operating stroke becomes shorter than a case where the operating lever is tilted in the "upper right" direction.

c) As shown in FIG. 17, in reference to "upper right," "lower right," "upper left" and "lower left" select switches 41 (on the right-hand side of FIG. 17), the head portion 42*a* of each switch operating unit 42 is made thinner than the head portion 46*a* of the switch operating unit 46 of an "upper," "lower," "left" or "right" select switch 63 (on the left-hand side of FIG. 17) so as to provide a gap between an operating pin 43 and a flange 44. When the lever is tilted in the "upper right," for example, the operating pin 43 is not immediately pressed by the flange 44 but pressed after it is slightly tilted. Consequently, the operating stroke becomes longer than that of the "upper" select switch 45 in which the operating pin 45 is pressed immediately after the lever is tilted.

Figure 18:
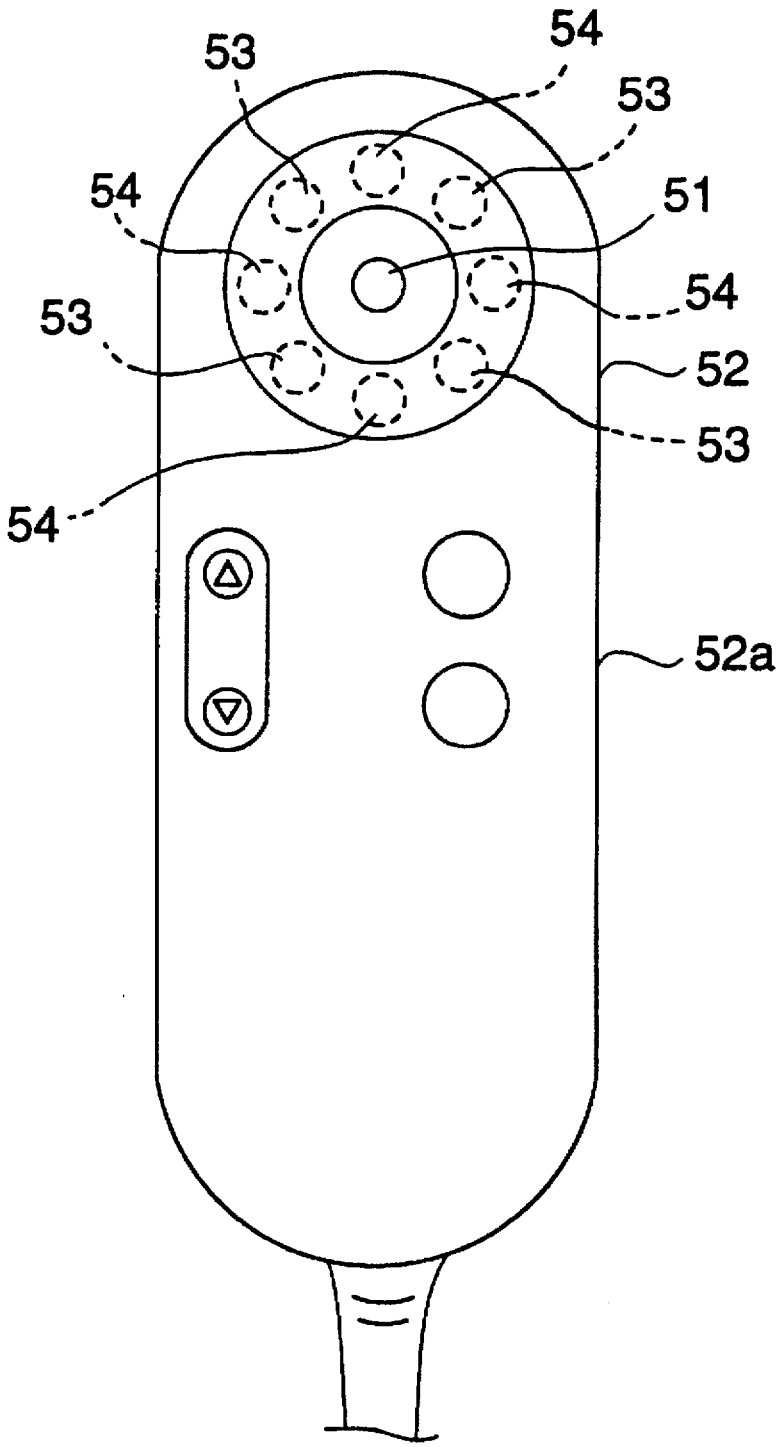
FIG. 18 shows a top view of the other embodiment of the present invention.

(ii) In a case where a lever switch device comprises a longitudinal case, as shown in FIG. 18, select switches furnished therein and the like other than the above embodiment of the invention, the operating stroke of a select switch 53 obliquely positioned with respect of the side 52*a* of the longitudinally-long case 52 in the longitudinal direction may be set shorter than that of the remaining select switch 54.

As a result, the operating range of the operating lever 51 for the select switch 53 becomes wider than that of the select switch 54. When the operating lever 51 is operated while the case 52 is held, the operating range of the select switch 53 in the direction in which the operating lever 51 is not readily tilted remains wide, so that the operating lever can be operated without incongruity in any direction as operating feeling in every direction is generally well-balanced.

(iii) The switches 3, 4 to be activated by the pressing or tilting operation of the operating lever in the above embodiment of the invention are not limited to the switching means stated above but may include any other switching means such as a tact switch and the like.

(iv) Although a description has been given of the case where the number of select switches arranged in the annular range is eight in the embodiments of the present invention above, the invention is applicable to a case where the number of switches is other than eight.

Further, the present invention is not limited to the embodiments thereof described above and illustrated in the drawings but may be modified in various manners without departing from the spirit and scope of the invention.

What is claimed is:

1. A lever switch device, comprising:

an operating lever that is tiltable into and about a plurality of tilting positions;

a plurality of switch elements disposed about the operating lever;

a plurality of operating elements, wherein each of the plurality of operating elements corresponds to one of said plurality of switch elements, wherein tilting of said operating lever into a tilting position displaces an operating element, said displacement causing a corresponding switch element to be actuated, wherein selected ones of the operating elements actuate corresponding switch elements in response to a first amount of tilting of the operating lever, and wherein others of said operating elements actuate corresponding switch elements in response to a second amount of tilting of said operation lever; and a housing that extends along a longitudinal axis and that accommodates the operating lever, the plurality of switch elements and the plurality of operating elements, wherein tilting said operating lever said first amount in an acute angular direction relative to the longitudinal axis displaces one of the select ones of the operating elements and wherein tilting said operating lever said second amount in one of a parallel direction and a perpendicular direction relative to the longitudinal axis displaces one of said others of said operating elements.

2. A lever switch device according to claim 1, wherein the first amount is smaller than the second amount.

3. A lever switch device according to claim 1, wherein the first amount is larger that the second amount.

4. A lever switch device according to claim 1, wherein an image on a display unit is scrolled in response to tilting of said operating lever.

5. A lever switch device according to claim 4, wherein an amount of tilting of said operating lever required to scroll an image up and down on a display unit is smaller than the amount of tilting required to scroll an image in directions other than up and down.

6. A multidirectional switch device, comprising:

an operating lever that is tiltable between a neutral position and a plurality of tilting positions and from one of the plurality of tilting positions to another one of the plurality of tilting positions;

a plurality of switch elements disposed about the operating lever in a generally circular configuration and interconnected to each other to form a switch matrix circuit for outputting digital data, the plurality of switch elements being greater than four switch elements; and a plurality of operating elements, wherein each of the plurality of operating elements corresponds to one of said plurality of switch elements, wherein tilting of said operating lever into a tilting position displaces an operating element, said displacement causing a corresponding switch element to be actuated, wherein selected ones of the operating elements actuate corresponding switch elements in response to a first amount of tilting of the operating lever, and wherein others of said operating elements actuate corresponding switch elements in response to a second amount of tilting of said operation lever; and wherein said selected ones of the operating elements and said others of said operating elements are alternately disposed about the operating lever.

7. A multidirectional switch device according to claim 6, wherein said first amount is smaller than said second amount.

8. A multidirectional switch device according to claim 6, wherein said first amount is larger than said second amount.

9. A multidirectional switch device according to claim 6, wherein said switch matrix is configured to output digital data indicative of which of said switch elements has been activated.

10. A multidirectional switch device, comprising:

a lever tiltable in multiple directions;

a plurality of switch elements so located as to surround the lever, said plurality of switch elements being interconnected into a matrix form to constitute a switch matrix circuit and including alternating ones of OR switch elements and non-OR switch elements; and a plurality of operating elements, each of which is displaced in interaction with the lever to operate any one of the plurality of switch elements when a corresponding one of the plurality of operating elements is displaced by a predetermined operating stroke in accordance with the tilting of the lever, wherein the switch matrix circuit outputs digital data indicating a selected one of the plurality of switch elements has been activated in conformity with a selected direction in which the lever has been tilted, wherein the digital data which is output from the switch matrix circuit is an OR signal when one of the OR switch elements and an adjacent one of the non-OR switch elements are simultaneously activated and wherein an OR operating element associated with a corresponding OR switch element is responsive to a first amount of tilting of the lever and a non-OR operating element associated with a corresponding non-OR switch element is responsive to a second amount of tilting of the lever, the first and second amounts of tilting of the lever being different from one another.

* * * * *